United States Patent [19]

Wahler

[11] Patent Number: 5,071,302

[45] Date of Patent: Dec. 10, 1991

[54] NOTCHED DOUBLE SEAMING CHUCK

[75] Inventor: Richard O. Wahler, Palatine, Ill.

[73] Assignee: Continental Can Company, Inc., Norwalk, Conn.

[21] Appl. No.: 243,995

[22] Filed: Sep. 13, 1988

[51] Int. Cl.[5] ..... B21D 51/26

[52] U.S. Cl. ..... 413/31; 220/276; 220/277; 413/32

[58] Field of Search ..... 413/26, 27, 32, 43, 413/31, 33, 2, 4, 6, 12, 14, 15, 16; 100/54, 55, 56, 58, 59, 60, 61; 220/90.6, 276, 277

[56] References Cited

U.S. PATENT DOCUMENTS

| | | | |
|---|---|---|---|
| 2,467,154 | 4/1949 | Peterson, Jr. . | |
| 2,606,515 | 8/1952 | Bryant . | |
| 2,711,706 | 6/1955 | Gueffroy . | |
| 3,483,355 | 12/1969 | Murdock . | |
| 3,855,026 | 12/1974 | Fox et al. | 220/90.6 |
| 3,939,789 | 2/1976 | Anders . | |
| 4,217,843 | 8/1980 | Kraska | 413/12 |
| 4,455,114 | 6/1984 | Zysset . | |

FOREIGN PATENT DOCUMENTS

WO84/03850 10/1984 PCT Int'l Appl. .

WO85/05299 12/1985 PCT Int'l Appl. .

*Primary Examiner*—D. S. Meislin
*Assistant Examiner*—Jack Lavinder
*Attorney, Agent, or Firm*—Woodcock Washburn Kurtz Mackiewicz & Norris

[57] ABSTRACT

This relates to the double seaming of an end unit to a metal can body where the end unit is of the full opening, easy opening type incorporating a pull tab for the purpose of initiating a rupture followed by pull out of an end panel of the end unit. Most specifically, the end unit is of an oblong rectangular or generally other than round outline so as to have a fixed orientation with respect to a double seam forming double seaming chuck. By having a fixed relationship between each end unit and the double seaming chuck and the pull tab with respect to the configuration of the end unit, it is possible to form a notch in the underside of the double seaming chuck to clear the pull tab. This permits the pull tab to have a force applying nose thereof positioned closely adjacent to a chuck wall of the end unit so that it may overlie a score line or weakening line formed in the chuck wall radius between the chuck wall and the end panel.

7 Claims, 1 Drawing Sheet

FIG.1
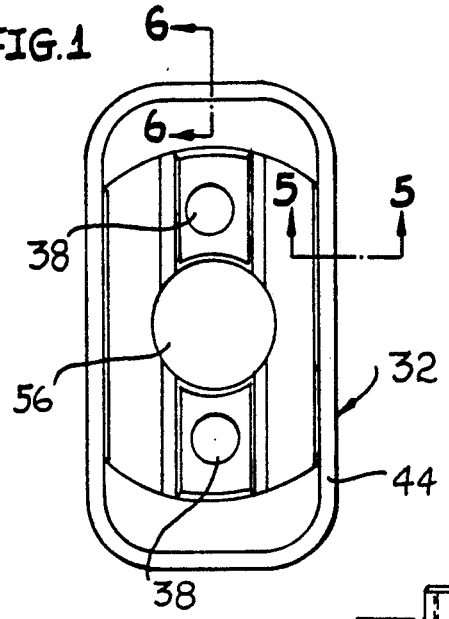
FIG.2
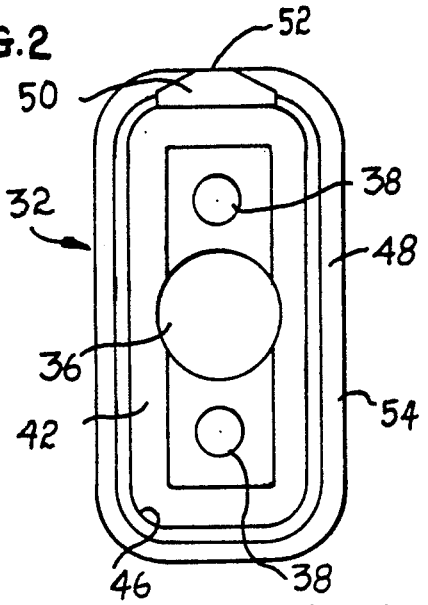
FIG.3
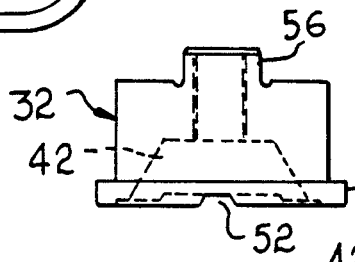
FIG.5
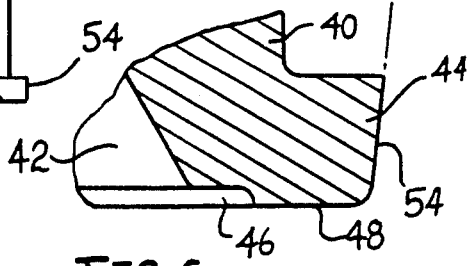
FIG.4
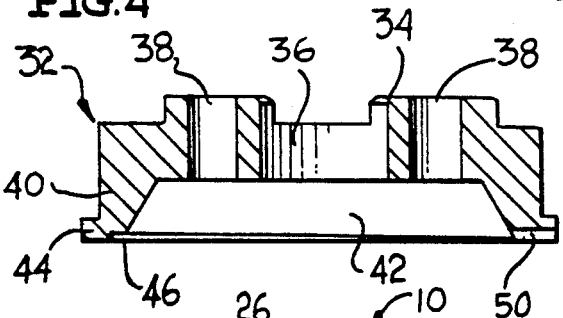
FIG.6
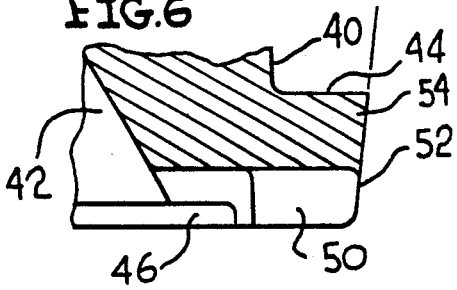
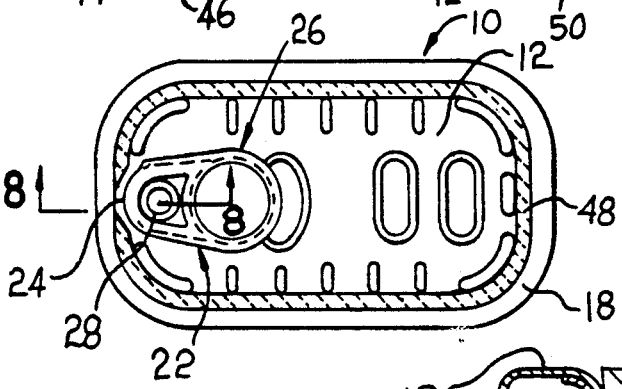
FIG. 8
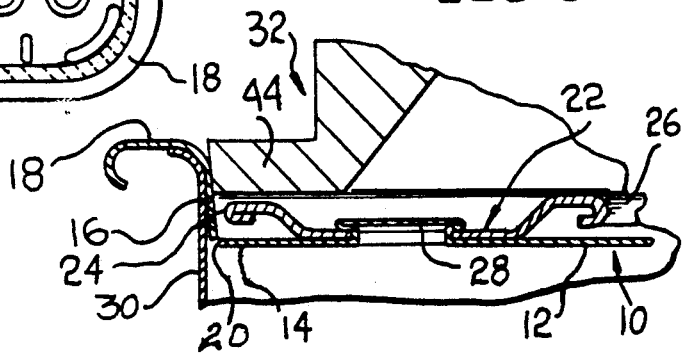
FIG.7

NOTCHED DOUBLE SEAMING CHUCK

This invention relates in general to new and useful improvements in the formation of easy opening end units and the double seaming of such end units to a can body. Most particularly, this invention relates to an oblong, rectangular or generally other than round end unit.

It is conventional to provide end units for cans which are secured to can bodies by double seaming operations including a seaming chuck which internally supports the end unit while the end unit is being double seamed to a can body utilizing seaming rolls. However, the necessity of backing up of a chuck wall of an end unit during the double seaming operation utilizing a double seaming chuck has presented difficulties to the positioning of a pull tab for facilitating the opening of such end unit.

More particularly, easy opening end units are conventionally formed with a score line or weakening line which defines a removable panel portion. That removable panel portion carries a pull tab which is conventionally secured thereto by way of a rivet. As will be apparent, it is desirable that the removable panel portion, particularly when the product packaged is a relatively solid product, correspond as closely as possible to the internal outline of the can body so that the product may be readily pushed out of the opened end of the can body. On the other hand, the pull tab carried by the end panel for first initiating the rupture of the end unit along the weakening line and then facilitating pull out of the removable panel portion, previously could not be positioned closely adjacent to the end unit chuck wall in that it would interfere with the engagement of the double seaming chuck with the end unit. In the past there has been developed pull tabs and end panel relationships which permit the pull tab, when initially lifted, to move axially from a position spaced from the associated weakening line to a position closely adjacent to or generally overlying such weakening line. These arrangements are complex and it is desired that they be replaced by a simple pull tab which is free of any hinge construction and which is directly secured to the end panel by the conventional rivet formation.

This invention is particularly directed to a container or can wherein the end unit is of an oblong, rectangular or generally other than round outline. In accordance with this invention, it has been found that because of the oblong or rectangular outline of the end unit, it is possible to accurately position thereon the pull tab at a preselected location. By having the same orientation of the pull tab with respect to the end unit in each and every instance, it is possible to, in accordance with this invention, provide a double seaming chuck which has a notch primarily in the under surface thereof in alignment with the preselected position of the pull tab so as to clear the pull tab. The notch is of a construction arrangement so as to provide for a minimal disruption of the double seaming chuck exterior wall.

The foregoing arrangement most particularly permits the score line or weakening line to be placed in the chuck wall radius between the chuck wall and the end panel of the end unit, thereby providing for acomplete removal of the end panel upon the opening of container. Further, the notching of the double seaming chuck permits the pull tab to have the nose thereof positioned closely adjacent to the chuck wall of the end unit and generally in overlying relation to the weakening line so as to provide for proper opening of the container.

With the above and other objects in view that will hereinafter appear, the nature of the invention will be more clearly understood by reference to the following detailed description, the appended claims, and the several views illustrated in the accompanying drawings.

FIG. 1 is a plan view of a double seaming chuck formed in accordance with this invention.

FIG. 2 is a bottom plan view of the seaming chuck and shows the notch in the underside thereof for clearing the pull tab.

FIG. 3 is an in elevational view of the notched end of the double seaming chuck.

FIG. 4 is a longitudinal sectional view taken through the center of the seaming chuck and shows generally the configuration thereof.

FIG. 5 is an enlarged fragmentary transverse vertical sectional view taken generally along the line 5—5 of FIG. 1 and shows the configuration of the double seaming chuck which engages an end unit.

FIG. 6 is an enlarged fragmentary longitudinal vertical sectional view taken generally along the line 6—6 of FIG. 1 and shows the general details of the notch for clearing the pull tab.

FIG. 7 is a plan view of an end unit to be engaged by the double seaming chuck with there being shown thereon the outline of contact of the double seaming chuck with the end unit.

FIG. 8 is an enlarged fragmentary vertical sectional view taken generally along the line 8—8 of FIG. 7 and shows specifically the structure of the end unit and its relationship to a can body and the double seaming chuck.

Referring now to the drawings in detail, reference is first made to FIGS. 7 and 8 wherein there is illustrated an end unit, generally identified by the numeral 10, to which the invention is applicable. The end unit 10 is of an oblong or generally rectangular configuration with the configuration being such that an accurate alignment of the end unit with a double seaming chuck occurs each and every time.

As is best shown in FIG. 8, the end unit 10 is of a stamped metal configuration and includes an end panel 12 which is connected by means of a chuck wall radius 14 to an upstanding chuck wall 16. The chuck wall 16 carries a conventional outwardly directed seaming curl 18.

The end unit 10 is of the easy opening type and is provided with a peripheral score line or weakening line 20 which is formed in the chuck wall radius 14. In the opening of a container incorporating the end unit 10, the end unit is ruptured along the weakening line 20 with the entire end panel 12 being removed.

In order to facilitate the removal of the end panel 12, there is provided a pull tab generally identified by the numeral 22. The pull tab 22 is of a rigid construction and basically includes a nose 24 and a finger receiving ring 26. Intermediate to nose 24 and the finger receiving ring 26, as is best shown in FIG. 8, the pull tab 22 is secured to the end panel 12 by means of an integral rivet 28 in a customary manner.

A principal feature of the end unit 10 and pull tab 22 combination is that the nose 24 of the pull tab may be placed closely adjacent the chuck wall 16 in a position generally overlying the weakening line 20. This has not heretofore been possible.

This also permits the complete removal of the end panel 12.

A particular feature of the end unit 10 is that the end unit 10 being rectangular, oblong or other than round in outline, it is possible to accurately position the end unit at the time of the application of the pull tab 22 so that the orientation of the pull tab 22 with respect to the end unit 10 is the same in each and every end unit.

Referring now to FIGS. 1 through 6, it will be seen that there is illustrated the details of a double seaming chuck which is specifically adapted for use in a double seamer to secure the end unit 10 to a can body 30 in a conventional manner. The double seaming chuck, which is generally identified by the numeral 32, is of an oblong, rectangular or generally other than round outline conforming to the outline of the inner surface of the chuck wall 16. The double seaming chuck 32 is of a type which is conventionally utilized and as is best shown in FIG. 4 includes an upper mounting portion 34 which includes a large central opening 36 for an aligning pin and spaced bores 38 for fasteners.

The double seaming chuck 32 also includes a depending skirt portion 40 so as to provide a hollow underside 42. The skirt portion 42 terminates in a lower outwardly directed flange portion 44 with the underside of the skirt portion 40 being further relieved as at 46. The relief 46 defines the outline of a foot area 48 which engages the end panel 12.

If it were not for the pull tab 22, the cross section of the skirt 40 would be that of FIG. 5 throughout the periphery of the double seaming chuck 32. However, in accordance with this invention, the underside of the skirt 40 is notched or cut out as at 50 and the foot 48 is interrupted. As will be readily apparent from FIG. 2, the notch 50 is very wide at its inner end and slopes at an angle on the order of 20° to the end surface of the outline of the double seaming chuck to provide for a slight opening 52 in an exterior wall 54 of the skirt 40 in the manner best shown FIG. 6.

As is clearly shown in FIG. 6, the notch 50 is of a height only sufficient to clear the pull tab 22.

Referring once again to FIG. 1, it will be seen that the top portion 34 is of a configuration and plan for association with a double seaming apparatus and that the opening 36 carries a pin 56 with an enlarged head for accurately positioning the double seaming chuck in the double seaming apparatus.

Referring once again to FIG. 7, it will be seen that there is schematically illustrated the footprint of the foot 48 of the double seaming chuck 32 on the end panel 12. At this time it is to be noted that the end panel 12 may be provided with certain projections and recesses so as to both stiffen the end panel and assure accurate positioning of the double seaming chuck 32 relative to the end unit 10

Reference is next again made to FIG. 8 wherein it is to be noted that a portion of the double seaming chuck 32 has been illustrated positioned relative to the end unit 10. It is to be noted that the notching of the underside of the double seaming chuck provides clearance for the pull tab 22. At this time it is pointed out that since the pull tab 22 is accurately positioned in the same position on each and every end unit and since each and every end unit is accurately positioned relative to the double seaming chuck 32, it is possible to position the pull tab 22 in the desired position and to provide the double seaming chuck 22 with the relatively small notch 50 which will permit clearance for the pull tab 22 without unduly weakening the double seaming chuck 32.

Although only a preferred embodiment of the double seaming chuck and an end unit to be associated therewith have been specifically illustrated and described herein, it is to be understood that minor variations may be made in the configuration of the double seaming chuck for use in combination with other configuration end units may be effective without departing from the spirit and scope of the invention as defined by the appended claims.

I claim:

1. A seaming chuck for use in a double seaming operation for securing an end unit to a can body wherein said end unit carries a pull tab in a preselected position relative to said end unit, said seaming chuck having means for assuming a predetermined orientation relative to an associated end unit, said seaming chuck having an exterior wall for engaging and backing up an end unit chuck wall during a double seaming operation, and said seaming chuck having a notch through said exterior wall in alignment with the preselected position of the pull tab to automatically clear the pull tab.

2. A seaming chuck according to claim 1 wherein said seaming chuck has an under surface for opposing and seating on an end unit, and said notch being primarily in said under surface.

3. A seaming chuck according to claim 1 wherein said seaming chuck has an under surface for opposing and seating on an end unit, and said notch being primarily in said under surface and extending through a minor opening in said exterior wall.

4. A seaming chuck according to claim 1 wherein said notch is of a minimum width at said exterior wall.

5. A seaming chuck according to claim 1 wherein said notch partial height opening in said exterior wall.

6. A combination of a seaming chuck and an end unit to be applied by said seaming chuck, said end unit being generally rectangular in outline and including an end panel joined to an upstanding chuck wall by a chuck wall radius, said end panel being removable from the remainder of said end unit along a peripheral weakening line formed in said chuck wall radius, and there being a pull tab overlying and connected to said end panel for pivotal movement, said pull tab having a nose engageable with said end panel at said weakening line to initiate rupture of said end unit along said weakening line, said seaming chuck having means for assuming a predetermined orientation relative to an associated end unit, said seaming chuck having an exterior wall engaging and backing up said end unit chuck wall during a double seaming operation, and said seaming chuck having a notch through said exterior wall in alignment with said pull tab to automatically clear said pull tab.

7. The combination of claim 6 wherein said pull tab nose is positioned closely adjacent said chuck wall and in overlying relation to said weakening line.

* * * * *

UNITED STATES PATENT AND TRADEMARK OFFICE

CERTIFICATE OF CORRECTION

PATENT NO. : 5,071,302

DATED : December 10, 1991

INVENTOR(S) : Richard O. Wahler

It is certified that error appears in the above-identified patent and that said Letters Patent is hereby corrected as shown below:

Column 4, line 41, after "notch" insert -- defines a --.

Signed and Sealed this

Ninth Day of March, 1993

*Attest:*

STEPHEN G. KUNIN

*Attesting Officer*

*Acting Commissioner of Patents and Trademarks*